United States Patent [19]

Hiraoka et al.

[11] 3,948,328

[45] Apr. 6, 1976

[54] PNEUMATIC IMPACT WRENCH WITH TORQUE RESPONSIVE CONTROL

[75] Inventors: Masaaki Hiraoka, Yao; Hiromu Terada, Ikoma, both of Japan

[73] Assignee: Nippon Pneumatic Manufacturing Co., Ltd., Japan

[22] Filed: Sept. 23, 1974

[21] Appl. No.: 508,270

[30] Foreign Application Priority Data

Sept. 26, 1973 Japan ..... 48-109140

[52] U.S. Cl. ..... 173/12; 73/139

[51] Int. Cl.[2] ..... B25B 23/145

[58] Field of Search ..... 173/12; 73/139

[56] References Cited

UNITED STATES PATENTS

| | | | |
|---|---|---|---|
| 2,867,117 | 1/1959 | Ernst | 73/139 |
| 3,608,131 | 9/1971 | Hornschuch et al. | 173/12 |
| 3,643,749 | 2/1972 | Pauley | 173/12 |

*Primary Examiner*—Ernest R. Purser

*Attorney, Agent, or Firm*—Wenderoth, Lind & Ponack

[57] ABSTRACT

A pneumatic impact wrench. This device is characterized in the improvement of the torque controlling mechanism incorporated therein, said mechanism comprising a torsion bar, a spindle case, a fluid element, and valves, holes and passages all functioning in close linkage with each other thereby enabling execution of the torque control and even change of the torque control value precisely. In this mechanism, an air motor driving this device is brought to a halt automatically as the result of closing of a main valve in relation to the operation of said fluid element, said operation of said fluid element being available from air pressure change caused by the closing or narrowing of an air exhausting hole taking place in compliance with twisting of said torsion bar under its partially rolling effect at the rear portion thereof, said torsion bar fixing to said spindle case at their forward portions at this time being imparted with a rotation-suspending resistance thereto at their fixing portion. This invention is further advantageous in that conventionally used automated valves can be dispensed with besides simplification of circuits being available in the above-mentioned mechanism.

2 Claims, 7 Drawing Figures

PNEUMATIC IMPACT WRENCH WITH TORQUE RESPONSIVE CONTROL

The present invention relates to an impact wrench and in particular to a pneumatically operable impact wrench characterized in the improvement of a torque controlling system incorporated therein. The torque controlling mechanism under the driving effect of a pneumatic motor comprises a fluid element and a torsion bar for controlling the torque and even to change the control value with precision. The above mechanism is also less complex than conventional devices of this kind.

Conventional devices of this kind dependent on a timer-system are defective in that they are likely to cause errors in torque tightening besides being mechanically complicated and usually comprising automated valves, complicated circuits and the like.

A main object of this invention is to provide a pneumatically driven impact wrench without the defects of conventional devices of this kind by an improvement in the torque controlling system incorporated therein, said torque controlling mechanism comprising a fluid element and a torsion bar which enable not only simplification of this mechanism but also executing the control and even changing the control value with precision.

The object of this invention will be accomplished by the improvement, combination and operation of every part constituting this invention, the preferred embodiment of which will be illustrated in relation with the annexed drawing as following.

Figure 1:
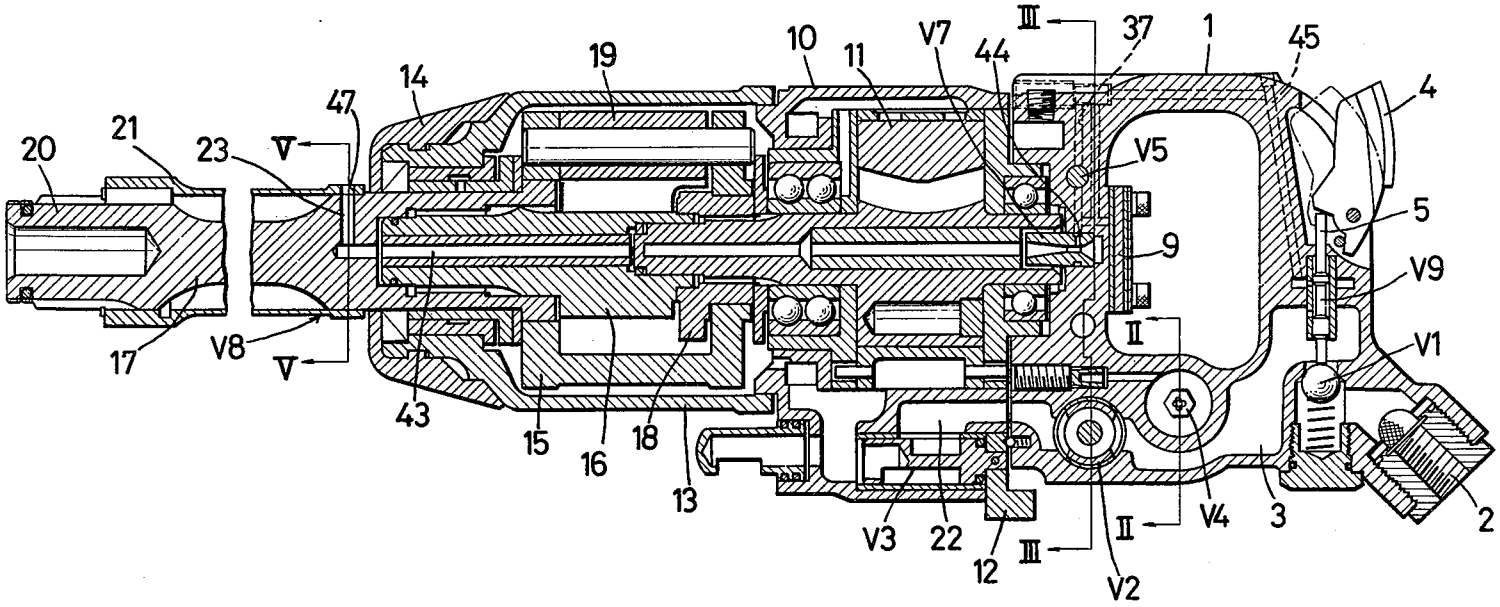
FIG. 1 is a longitudinal section front view of an impact wrench of this invention.

In FIG. 1, a handle 1 of the impact wrench has an air inlet 2 and an air passage 3 therein, and an elevatable rod 5 abutting against an inlet valve V1 located between said air inlet 2 and an air passage 3. Said rod 5 is controlled by a lever 4 which is fitted to said handle 1. When no pushing pressure is applied to the manually operable lever 4, said inlet valve V1 stays closed under the effect of a spring, and upon pushing the lever 4, the elevatable rod 5 is pushed by said lever 4, thereby opening said inlet valve V1. The elevatable rod 5 concurrently plays the role of a control valve V9 in such a manner that when the lever 4 pushes down the rod 5, the passage 3 is shut off from a communication hole 45, and when said rod 5 stays in an elevated state said passage 3 communicates with said communication hole 45.

Also in said handle 1, there are a main valve V2, a pressure adjusting valve V4, and inside the periphery of said handle 1 there is a fluid element 9.

Said fluid element 9 is of the kind generally sold in the market, and in this invention a flip-flop element, a product of Imperial Eastman Corporation of U.S.A., is used. This element has one inlet, two control orifices, and two outlets for sending the air supplied through the inlet to either one of the two outlets, the outlets in this process being switchable to and from each other by imparting a slight amount of air for a short time to one of said control orifices so as to make it accord with the "switching-to" outlet. Thereafter, the air is sent continuously to the one outlet only until it is switched over to the other outlet by way of the foregoing process.

In front of said handle 1 a cylindrical case 10 is mounted in which an air motor 11 is incorporated, and a switch valve V3 for switching the rotating direction of said air motor 11 is provided at the lower portion of said case 10, said valve V3 being manually operatable via a lever 12.

A hammer case 13 is fixed to the cylindrical case 10 at the front thereof, and has a cap 14 fixed thereto at the forward portion thereof. Within said hammer case 13 a hammer frame 15 is rotatably installed to which at the center thereof is fitted rotatably an anvil 16, said anvil 16 at its forward portion linked to a torsion bar 17 at its rear terminal via a spline or the like so that the anvil 16 and the torsion bar 17 rotate together. To the rear portion of said hammer frame 15 a driver 18 is rotatably fitted which connects with said air motor 11 at its rotary shaft via a spline. Said hammer frame 15 is axially fixed with a hammer 19, thereby enabling the hammer 19 to rotate with the driver 18, anvil 16 and the torsion bar 17 in communication with the rotation of the air motor 11 when the resistance to the torsion bar 17 is in the neighborhood of zero. When the resistance applied to the torsion bar 17 is so strong as to stop the rotation of said torsion bar 17, said anvil 16 in connection with the torsion bar 17 is brought into rotation again by the driver 18 and the hammer 19 which continue to rotate in disregard of the rotational-halt of said torsion bar 17.

The torsion bar 17 at its forward terminal is provided with an inserting portion 20 for inserting various sockets therein, to said sockets chosen so as to be screwed bolt and nut fashion. Said torsion bar 17 is further at its forward portion fixed to a spindle case 21 at the inside forward tip thereof by means of keying and the like.

Figure 5:
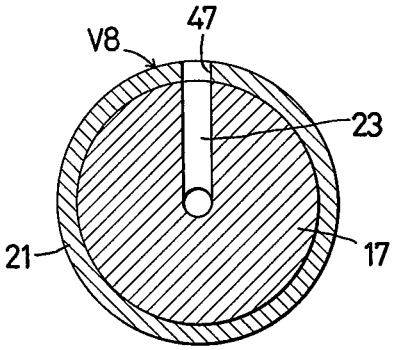
FIG. 5 is a section between V and V in FIG. 1 showing the valves in an opening state.
Figure 6:
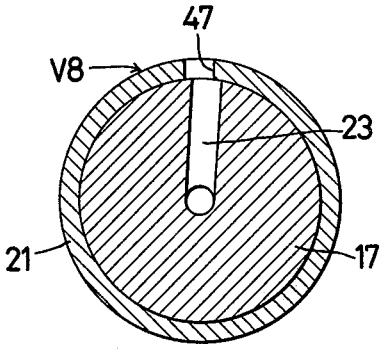
FIG. 6 is the same section as in FIG. 1 showing the closed state of the valves.

The spindle case 21 concurrently plays the role of a rotation-suspending valve V8 and is fitted over said torsion bar 17, said torsion bar 17 and said spindle case 21 being free of each other at their rear portions, but fixed to each other at their forward portions as described hereinbefore. The torsion bar 17 is provided with an exhaust passage 23 which communicates with an exhaust hole 47 provided in said valve V8 when said torsion bar 17 is straight in relation with said valve V8, i.e. the spindle case 21, as shown in FIG. 5. When said exhaust passage 23 and said exhaust hole 47 are not in the communicating position with each other the exhaust passage narrows or is totally closed. That is, when said torsion bar 17 in rotary movement with said spindle case 21 meets a rotation-suspending resistance and the torsion bar 17 at its fixing portion is caused to twist at the rear portion thereof, as shown in FIG. 6. Said spindle case 21 is made of material harder than the twistable torsion bar 17 so as to be suitable for the above process.

Figure 3:
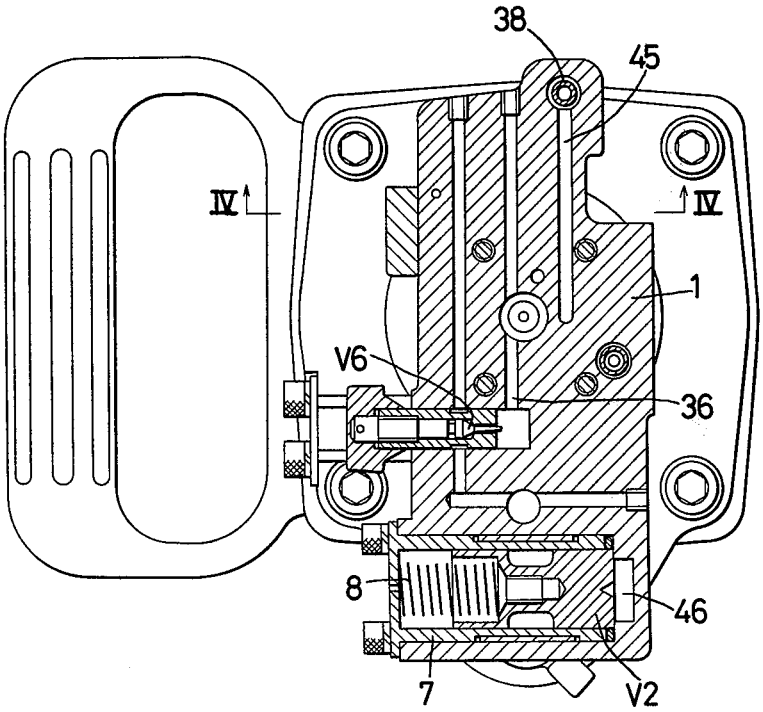
FIG. 3 is a side view of a section between III and III in FIG. 1.
Figure 4:
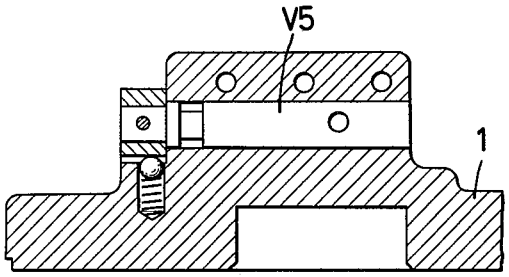
FIG. 4 shows a magnified section between IV and IV in FIG. 3.
Figure 7:
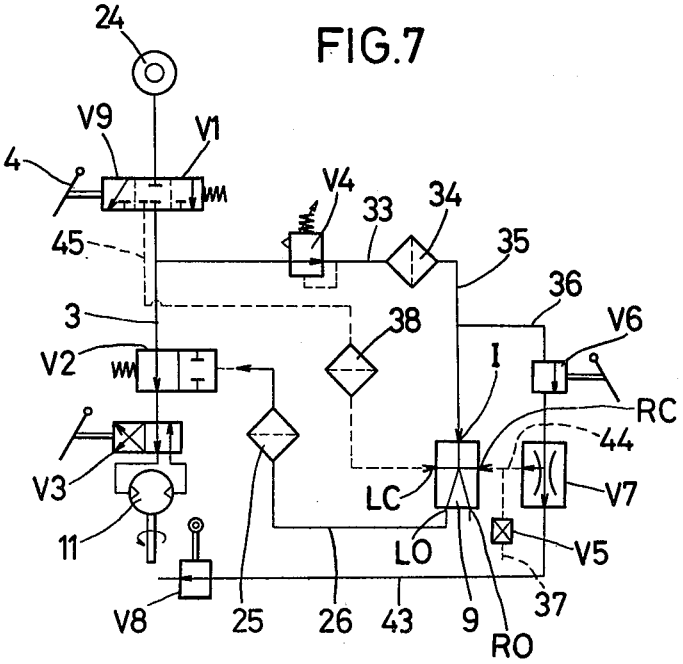
FIG. 7 shows circuits of the present invention.

In FIG. 7, a compressed air source 24 communicates with the air passage 3 via the inlet valve V1, said air passage 3 further communicating with the main valve V2 and the pressure adjusting valve V4. The main valve V2, as shown in FIG. 3, fits movably in a bushing 7 against the support of a spring 8 therein, thereby enabling the air passage 3 either to communicate with or shut itself off from the switch valve V3 at its inlet 22. Within said handle 1, there is also a pilot chamber 46 facing in opposition to said spring 8, said pilot chamber 46 communicates with the left side outlet L0 of said fluid element 9 via the passage 26 which has a filter element 25 as shown in FIG. 7, and the right side outlet R0 of said fluid element 9 is open to the atmosphere.

Figure 2:
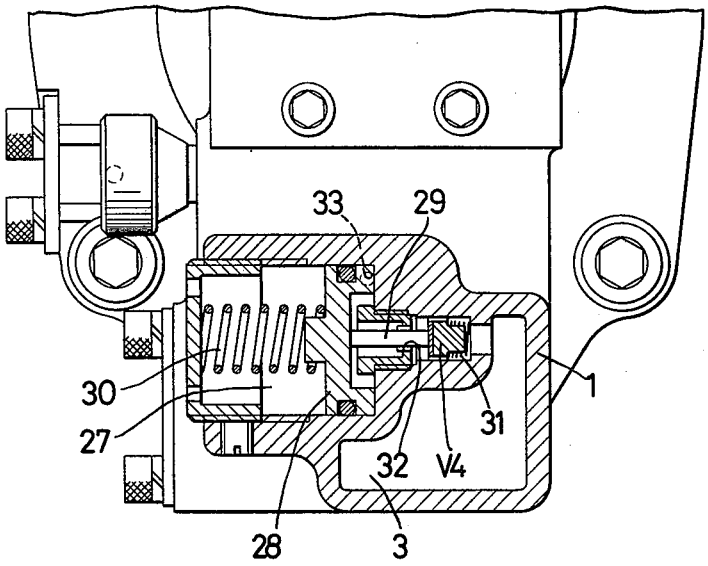
FIG. 2 is a side view of a section between II and II in FIG. 1.

Also in the handle 1, shown in FIG. 2, a cylinder 27 is installed which incorporates a piston 28 therein. Inbetween said piston 28 and said pressure adjusting valve V4 there is sandwiched a pin 29 causing said piston 28 and said valve V4 to be pushed opposedly against said pin 29 at both edges thereof by springs 30 and 31, respectively. In this state, said spring 30 is far stronger than the spring 31 thereby causing said piston 28, pin 29 and said pressure adjusting valve V4 to be pushed by said spring 30 so as to keep open said valve V4 at its valve orifice 32 when no air pressure is imparted to said air passage 3 communicated with said valve V4 as described hereinbefore. In turn, when air pressure acts on said air passage 3, said air pressure acts on said piston 28 via the valve orifice 32, thereby moving said piston 28 against said spring 30, and thereby allowing air to feed to a passage 33 which communicates with said valve orifice 32. At this time, when more air pressure is imparted to the air passage 3, the piston 28 and the valve V4 farther apart, thereby narrowing the valve orifice 32 and reducing the air flowing to said air passage 33 through said valve orifice 32.

Shown in FIG. 7, the air passage 33 incorporating a filter element 34 communicates with said fluid element 9 at the inlet I thereof and also a needle valve V6 all via a pilot passage 35.

Said needle valve V6, as seen in FIG. 7, is provided so as to be manually adjustable on a passage 36 which branches out intermediately from said pilot passage 35. Said passage 36 communicates with a fixed throttle valve V7 via said needle valve V6. Said throttle valve V7 as clarified in FIG. 1 forms a venturi at the front center of said handle 1, and said valve V7 communicates with the exhaust hole 23 of the torsion bar 17 via a passage 43 communicating with said air motor 11 and anvil 16 at their central portions. Said throttle valve V7 at the narrowest portion thereof has a small hole 44 communicating with the afore-mentioned fluid element 9 at the right side control orifice RC thereof.

The fluid element 9 at the left side control orifice LC thereof also communicates with the foregoing communication hole 45 and is equipped intermediately with a filter element 38. An exhaust port 37 is further provided in said handle 1, and is branched intermediately from said small hole 44 thereby opening it to the atmosphere. Said exhaust port 37 is opened or closed by a manually-operating stop valve V5 also adapted in said handle 1.

The foregoing mechanism functions as below:

In the closing state of the stop valve V5, the lever 4 is pushed for opening the inlet valve V1 while simultaneously shutting off the air passage 3 from the communication hole 45. This results in compressed air from the compressed air source 24 entering into the air passage 3 through the air inlet 2 and from there flowing into the air motor 11 via the main valve V2, switch valve V3, and giving rotation to the air motor 11 at the rotator thereof. This rotates the driver 18, hammer frame 15, anvil 16 and the torsion bar 17, and finally imparts rotary movement to the nut, bolt or the like via a socket adapted to the plug 20.

Part of the compressed air is suitably adjusted to a normal pressure by means of said pressure adjusting valve V4 and then flows through the passage 33 and 35 to the needle valve V6 and the fluid element 9, respectively.

At the same time another portion of the compressed air applies an instantaneous pressure to the left-side control orifice LC of said fluid element 9 via said communication hole 45, said compressed air having been fed through the inlet 2 via the passage 3 with the manual pushing of said lever 4 that pushes down said elevatable rod 5 as the result, thereby releasing the air flowing from the inlet I of the fluid element 9 to the atmosphere through the right-side outlet R0 thereof.

Also, the air flowing in the needle valve V6 is released to the atmosphere via the needle valve V6 and the throttle valve V7, and through the passage 43, exhaust passage 23 and the valve V8 in that order. During this time, the throttle valve V7 at its diametrically-shortened portion has a negative pressure, and simultaneously the pressure in the small hole 44 communicating with this portion also is negative, thereby making it difficult to impart pressure to the right-side control orifice R0 of the fluid element 9 and thereby enabling the air flowing therein from the inlet I to jet outward continuously through the right-side outlet R0 thereof even after blocking said air passage 3 and said communication hole 45 due to the plunge of said elevatable rod 5.

The nut, bolt or the like is rotated and fastened with the application of the impact mechanism including said torsion bar 17 endowed with a strong torque by way of the foregoing process. The rotary movement of said torsion bar 17 at the inserting portion 20 thereof finally comes to a halt together with the spindle case 21 at the maximum of resistance of the nut, bolt or the like, thereby twisting said torsion bar 17 at the rear portion thereof free of said spindle case 21. The above process, relies on the fact that in the mechanism as referred to hereinbefore said spindle case 21 is fixed to said torsion bar 17 only at the inserting portion 20 thereof. As the result, the foregoing exhaust hole 47 on said spindle case 21 becomes aligned with said exhaust passage 23 as shown in FIG. 6, thereby narrowing said exhaustion passage 23 due to partial covering thereover by the spindle case 21 at the inside periphery thereof. Further twisting of said torsion bar 17 results in the complete closure of said exhaust passage 23. In this state, the spindle case 21 becomes the rotation-suspending valve V8 as mentioned hereinbefore.

With the above-described closing of said exhaust passage 23 and the stoppage of the outward flow of air therefrom, the air flow stops in said passage 43 thereby eliminating the negative pressure in the flow of air through the throttle valve V7 and reversely giving rise to the air pressure in said portion. This enables air to be fed from the needle valve V6 to the right-side control orifice RC of said fluid element 9 through said small hole 44. Accordingly, the air sent through the fluid element 9 from its inlet I changes to flow out from the left-side outlet L0 instead of the foregoing right-side outlet R0 and flows into the pilot chamber 46 of the main valve V2 via said passage 26. As the result, said main valve V2 moves against the spring 8 and blocks the air flow to the air motor 11 through said air passage 3, thereby stopping said air motor 11. With the stopping of said air motor 11, the torsion bar 17 revives, thereby bringing said exhaust passage 23 to an open state while keeping said fluid element 9 as it is and, accordingly, keeping said main valve V2 closed. Upon release of the lever 4 from the manual pressure applied thereto, said inlet valve V1 closes and because of the elevation of said elevatable rod 5, the compressed air in said air passage 3 makes a momentary flow into the left-side pilot orifice of the fluid element 9 via the communication hole 45.

When loosening nuts, bolts and the like by reverse rotation of the impact mechanism which doesn't require the torque control, the stop valve V5 is kept open to prevent the right-side control orifice RC of the fluid element 9 from the application of air pressure thereto thereby enabling the air motor 11 to rotate continuously.

What is claimed is:

1. A pneumatic impact apparatus connected to a compressed air source, said apparatus comprising:

a rotary air motor connected to said compressed air source;

a torsion bar operatively attached to said motor for rotation therewith, said torsion bar having an exhaust passage directed through the side thereof;

fastening tool means attached to the forward tip of said torsion bar for rotation therewith and for fastening objects with said apparatus;

spindle casing means surrounding a portion of said torsion bar, the front portion of said casing means being attached to the forward portion of the torsion bar for movement therewith and the rearward portion of the casing means being feee from rotation with the torsion bar, said casing means further having an exhaust outlet therethrough open to the atmosphere aligned with the exhaust passage in the torsion bar for allowing air to pass therethrough from the exhaust passage when the rear portion of the torsion bar is not rotating freely from alignment with the casing means, whereby when the front portion of the torsion bar ceases to rotate upon final fastening of the object to be fastened and the rearward portion of the torsion bar is still twisted under the rotational torque from the air motor, the spindle means attached to the front portion of the torsion bar ceases to rotate, causing the exhaust hole at the rear portion thereof to come out of alignment with the exhaust passage in the still twisting portion of the torsion bar, and thereby stopping the flow of air through the exhaust passage outward to the atmosphere through the exhaust opening;

main valve means in the air passage connecting said air source and said air motor for controlling the air flowing to the air motor from the source, said main valve means having a spring for continuously holding the valve open and an expandable pilot chamber fitted against the spring for compressing the spring and closing the main valve means when air pressure is directed into the pilot chamber;

fluid control means connected at the inlet thereto to the inlet to said main valve means through a pilot passage for controlling and directing the fluid flow through the apparatus, said control means having first and second control orifices opposite each other, a first outlet connected to said pilot chamber of said main valve means, and a second outlet open to the atmosphere;

pressure adjusting valve means in said pilot passage between said main valve means and said fluid control means for adjusting the pressure of the fluid flowing to said control means through the pilot passage;

throttle valve means having an inlet operatively connected to said pilot passage following the pressure adjusting valve means, a first outlet connected to said exhaust passage of said torsion bar, and a second outlet connected to said second control orifice of said fluid control means for controlling the flow of air to the exhaust passage means in the torsion bar and for reducing the pressure of the air at the second control orifice of the fluid control means to less than the pressure of the air entering the inlet of the fluid control means from the pilot passage to allow the air in the fluid control means to exit through the second outlet to the atmosphere;

first manually operated control valve means having an inlet connected to said air source and an outlet therefrom operatively connected to said main valve means for allowing air to flow to said main valve means and said air motor from said air source;

second control valve means operatively linked to said first control valve means for opening and closing in conjunction with the opening and closing of the first control valve means, said second control valve means having an inlet thereto connected to the outlet from said first control valve means and an outlet therefrom connected to the first control orifice of said fluid control means for imparting a control pressure to the fluid control means opposite the reduced pressure at the second control orifice when the first control valve is opened and air is allowed to flow through the main valve to rotate the air motor and the torsion bar attached thereto;

whereby opening the first control valve means: allows air from the air source to flow to and through the main valve means held open by the spring to the air motor to rotate the air motor and the torsion bar attached thereto; opens the second control valve means and allows air from the outlet of the first control valve means coming from the air source to flow to the first control orifice of the fluid control means to provide a control pressure for the fluid control means; and allows air from the air source to flow into and through the pilot passage and the pressure adjusting valve means to the inlet of the fluid control means and to the inlet of the throttle valve means from which the air flows to the exhaust passage of the torsion bar while the air pressure at the second control orifice opposite the control pressure entering from the first control orifice is reduced to less than the pressure of the air entering the inlet to the fluid control means, thus causing the air entering the fluid control means to exit through the second outlet to the atmosphere; and whereby closing the exhaust opening in the spindle casing due to the twisting of the torsion bar when the item to be fastened is fastened causes pressure to build up at the throttle valve and causes the pressure at the second control orifice to approach the pressure at the inlet from the pilot passage, thereby allowing the air in the fluid control means to pass out the first outlet therefrom to the pilot chamber of the main valve means, thus causing the pilot chamber to expand against the spring, close the main valve means, and halt the air flowing to the air motor, thereby discontinuing rotation of the motor and releasing the torque to the torsion bar, so that the exhaust passage and the exhaust outlet are once again aligned.

2. A pneumatic impact apparatus as claimed in claim 1 further comprising manual switch valve means connected to the inlet of said air motor for determining the direction of rotation of said air motor.

* * * * *